United States Patent [19]

Smith et al.

[11] 4,352,475

[45] Oct. 5, 1982

[54] AUDIO FREQUENCY TRACK CIRCUIT FOR RAPID TRANSIT APPLICATIONS WITH SIGNAL MODULATION SECURITY

[75] Inventors: Barry L. Smith; James R. Hoelscher, both of Rochester, N.Y.

[73] Assignee: General Signal Corp., Stamford, Conn.

[21] Appl. No.: 152,467

[22] Filed: May 23, 1980

[51] Int. Cl.[3] ..... B61L 21/00; B61L 3/00

[52] U.S. Cl. ..... 246/34 CT; 246/34 R; 246/63 C; 246/121; 246/167 R

[58] Field of Search ..... 340/47; 246/34 R, 34 B, 246/34 CT, 63 C, 63 A, 187 A, 187 B, 167 R, 120, 121

[56] References Cited

U.S. PATENT DOCUMENTS

| | | | |
|---|---|---|---|
| 3,361,905 | 1/1968 | Baughman | 246/63 C |
| 3,450,875 | 6/1969 | Whitten et al. | 246/167 R |
| 3,794,833 | 2/1974 | Blazek et al. | 246/34 CT |
| 3,868,075 | 2/1975 | Blazek et al. | 246/63 C |
| 3,946,972 | 3/1976 | Grundy | 246/34 CT |
| 4,065,081 | 12/1977 | Huffman et al. | 246/34 R |
| 4,074,879 | 2/1978 | Clark et al. | 246/34 CT |

*Primary Examiner*—James J. Groody

*Attorney, Agent, or Firm*—Pollock, Vande Sande & Priddy

[57] ABSTRACT

An audio frequency track circuit with improved security in the train detection function for rapid transit applications for use with uninsulated rails includes an improved transmitter and receiver. The transmitter modulates a track frequency carrier with a fixed code rate, regardless of the code rate employed to modulate the train information frequency. The receiver includes a decoder tuned to the track frequency modulation rate. By using such a sharply tuned decoder, the noise protection threshold is increased. Because of its application to uninsulated rails, with the associated lack of hard track circuit boundaries, adjacent track circuits have different track frequency modulation rates to insure that the modulated track frequency signal, from one track circuit, is not effective to operate a track relay in another circuit even under failure conditions.

7 Claims, 8 Drawing Figures

TRANSMITTER 10

RECEIVER 24

AUDIO FREQUENCY TRACK CIRCUIT FOR RAPID TRANSIT APPLICATIONS WITH SIGNAL MODULATION SECURITY

FIELD OF THE INVENTION

The invention relates to transmitters and receivers for use with signals injected into the track rails of a railway for the purpose of detecting the presence of a rail vehicle.

BACKGROUND OF THE INVENTION

Detecting the presence of railroad vehicles on a trackway is a problem which was originally solved with the invention of the track circuit. A track circuit is merely an electrical circuit in which electrical energy is applied to a section of railroad track at one point, and a detector of electrical energy is applied to another point of the railroad track. When a train enters the trackway between the transmitter and the receiver (typically the entrance end of a track section is in the vicinity of the receiver's connection), the steel wheel-axle combination shunts electrical energy away from the detector, and this lack of energy at the detector is used to indicate the presence of the train. In early track circuit applications, the circuit was well-defined by insulating the track rails at the boundaries of the track circuit. Thus, each track circuit could, for example, include only a single source of energy and accordingly, the need for elaborate measures to prevent false energization of the energy detector were minimal.

This state of affairs has changed radically with the use of rails in which track circuit insulated joints are eliminated. Elimination of the insulated joints required further measures to prevent spurious electrical energy from reaching the detector which energy has the potential for masking the presence of the train. One technique which has been adopted is the use of different frequencies of track frequency energy in adjacent track circuits, and "tuning" of the receiver to the appropriate frequency.

In an effort to expand the utility of track circuits, additional signalling currents have been imparted into them for the purpose of transmitting speed control information to the train. In these circuits, train information signals are carried by signalling current of a frequency which is different from the track frequency of any of the track circuits. One popular technique for transferring information to a train via a track circuit is to use one or just a few train information frequency carriers, but to modulate those carriers at different rates depending upon the speed control information sought to be transmitted.

In a majority of track circuits which have the capability of transmitting train information, the train information is carried by track currents flowing in the same rails which carry the train detection signalling currents. As a result, typical track circuits in use today are composed of transmitting and receiving equipment. The receiving equipment is used to detect the presence of track frequency currents and, when such currents are detected, to energize a relay to indicate the unoccupancy of the associated track section, and the transmitting equipment is used to generate both the track frequency and the train information signalling currents for application to the track circuit. In addition, for added security, track frequency carrier is modulated at one of a number of code rates.

An analysis of the operation of a track circuit will illustrate that the track relay must be capable of being energized by the track frequency signal in the presence of the train information signal, for this signal combination exists in every track circuit as the train occupying the track circuit exits the track circuit.

Since there was a desire to use modulated track frequency signal currents, and since there is the necessity of modulating the train information signalling currents, and since they typically flow in the track rails, the practice has grown up of using the train information code rate to modulate the track frequency energy. Partly, this is a result of the necessity for the track relay to pick up in the presence of train information modulated carrier. Thus, in effect, the transmitter power amplifier and track circuit is time shared at a code rate of the train information signal. When the train information carrier signal is on, the track frequency carrier is off and vice versa. This necessarily means that the track frequency carrier may be modulated at any of the code rates used for transmitting train information. And accordingly, the element in the train detection processing chain which detects the track frequency modulation must be of a characteristic which will accept any modulation rate within this range. For example, in a typical application, the modulation rates used are from 1.25 Hz. to 21.5 Hz. While these arrangements have operated quite well, and are actually in use in a number of rapid transit systems today, we have discovered that certain improvements are necessary and desirable.

Contemporaneous with the development of track circuits, briefly outlined above, the control arrangements for train power equipment has also been changing such that today modern control arrangements include pulse type control devices (for example, silicon control rectifiers or equivalent). The use of these pulse type devices along with the relatively larger amounts of power they switch (as compared to the signal circuits) can result in spectrally rich currents induced in the wayside equipment including the wayside track receiver. This has required the noise immunity of the track receiver to be as high as possible. However, the relatively broadly tuned modulation detection element hinders increasing the noise immunity of the track receiver.

Therefore, it is one object of the present invention to increase the noise immunity of the track circuit receiver. It is another object of the present invention to improve the noise immunity of the track receiver by sharply tuning the modulation detection element. It is another object of the invention to modulate track frequency carrier energy at a fixed rate so as to allow sharply tuning the modulation rate to which the receiver responds.

SUMMARY OF THE INVENTION

In accordance with the invention, the track circuit noise threshold is increased by arranging the receiver to respond to only a fixed modulation rate for track frequency carrier. Because the typical application for track circuits of the invention is with uninsulated rails, while the modulation rate for the track frequency carrier in any track circuit is fixed, that modulation rate is different for adjacent track circuits, and in practice, the modulation rate changes from track circuit to track circuit each track circuit using one of two rates. Accordingly, the receiver for train detection signal includes a decoder sharply tuned to the modulation rate of the corresponding transmitter.

In more detail, however, the present invention meets the foregoing objects in an automatic protection system for trains transversing uninsulated rails including, transmitting and receiving equipment spaced along the rails, the transmitting equipment including, a track frequency oscillator, modulator means for modulating a signal produced by the track frequency oscillator at a fixed code rate and producing a modulated signal, amplifying means for amplifying the modulated signal, bond means for applying the amplified modulated signal to the track rails, and the receiving equipment including:

decoder means responsive to signals derived from the track rails and tuned to said fixed code rate for producing a detectable output in response to detection of said fixed rate modulation, and output means operated to a distinctive condition only in response to said detectable output from said decoder means.

In addition to the foregoing equipment, the transmitter includes at least one train information carrier generator, a modulator for modulating the train information carrier with a selectable modulation rate, and a corresponding modulation generator for each of the available modulation rates, and an amplifier for commonly amplifying the modulated train information carrier and the modulated track frequency carrier for application of both signals to the track rails.

The receiver includes a bandpass filter coupled to the track rails, tuned to the track frequency carrier, a level detector responsive to the output of the demodulator, a decoder tuned to the fixed modulation rate of the track frequency carrier for that track circuit, and a track relay which is picked up when the decoder output exceeds some threshold to indicate the unoccupancy condition of the associated track circuit.

BRIEF DESCRIPTION OF THE DRAWINGS

The present invention will be further explained in connection with the attached drawings, so as to enable those skilled in the art to readily practice the same; in the attached drawings like reference characters identify identical apparatus and.

DETAILED DESCRIPTION OF PREFERRED EMBODIMENTS

Figure 1:
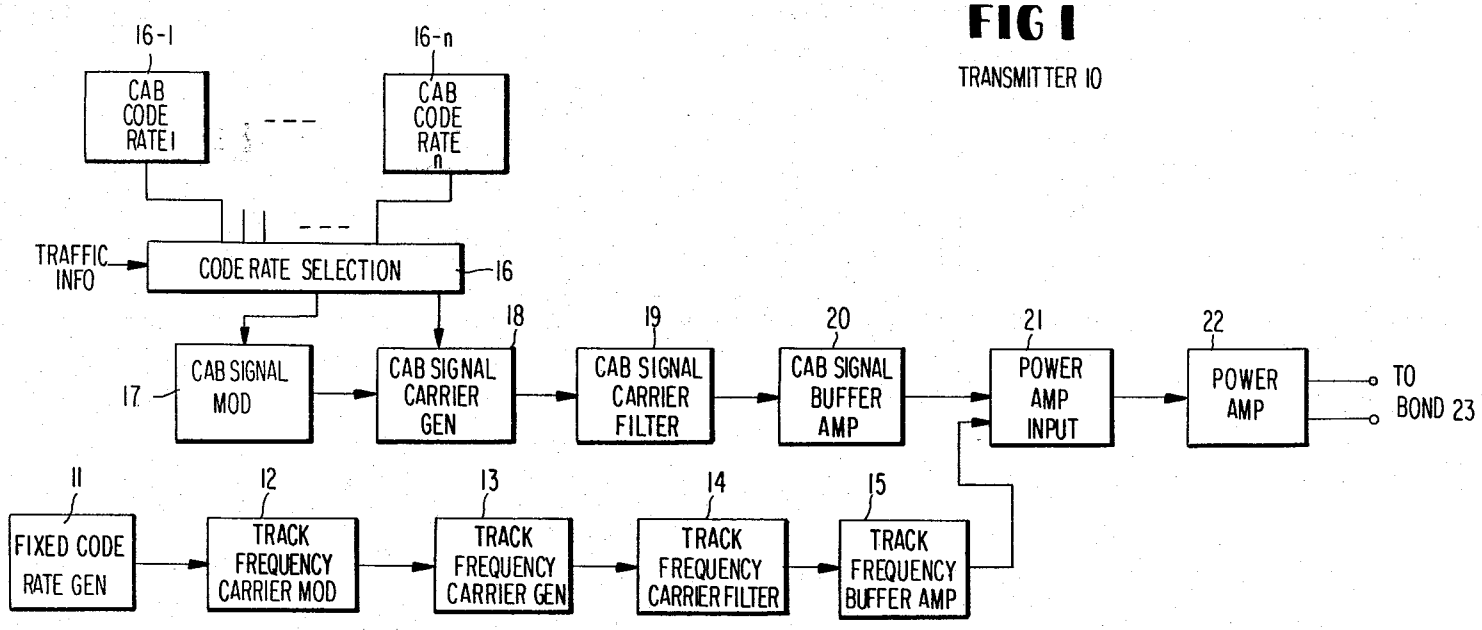
FIG. 1 is a block diagram of a track circuit transmitter 10 in accordance with the present invention.

FIG. 1 illustrates a preferred embodiment of a track curcuit transmitter 10. As shown in FIG. 1, the output of the track circuit transmitter 10 is coupled through a power amplifier input circuit 21 through a power amplifier 22 to a track circuit bond 23. The power amplifier input circuit 21 has a pair of inputs, a first input from a cab signal buffer amplifier 20, and a second signal input from a track frequency buffer amplifier 15.

The signal coupled from the track frequency buffer amplifier 15 originates at a fixed code rate generator 11. The fixed code rate generator 11 generates an output at a fixed code rate, such as, for example, 2 or 3 Hz. As will be explained hereinafter, adjacent track circuits preferably employ different fixed code rates such that, for example, in a typical system, one track circuit uses a 2 Hz. code rate generator, and adjacent track circuits use a 3 Hz. code rate generator.

The code rate generated by the code rate generator is coupled to a track frequency carrier modulator 12 where that signal is used to modulate a carrier signal produced by the track frequency carrier generator 13. In accordance with prior art techniques, a plurality of different track frequency carriers are employed. For example, prior art systems have employed arrangements using four train detection carriers arranged in sequential order in adjacent track circuits. For similar reasons, we choose to use different track frequency carriers in adjacent track circuits. In any event, the output of the track frequency generator 13 is a signal at the track frequency carrier, modulated at a rate determined by the rate of the fixed code rate generator 11.

This signal is filtered in the bandpass filter 14, amplified in the amplifier 15, and coupled to one input of the power amplifier input circuit 21.

In order to generate cab signal or train information, the transmitter 10 includes a plurality of additional components. Such typical components are illustrated in FIG. 1 and include a plurality of cab code rate generators, indicated in FIG. 1 as code rate generator 16-1 through 16-N, each generating a different code rate in the code rates 1-N. The code rate selection network 16 responds to traffic information, in a conventional manner, to select an effective code rate which is coupled to a cab signal modulator 17. The code rate selected by the code rate selection network 16, which may, for example, comprise a plurality of relay contacts, or other equivalent circuitry, is employed to modulate the carrier frequency generated by the cab signal (or train information) carrier generator 18. As a result, the output of the cab signal carrier generator 18 is a signal at the train information carrier frequency, modulated at a selected code rate. In some applications, each transmitter includes a plurality of cab signal carrier generators, and the code rate selection network 16 not only selects a particular code rate but also selects a particular carrier. Those skilled in the art will understand that one or more cab signal carrier generators can be employed as desired. In any event, a signal at the (selected) cab signal carrier which is modulated at the selected modulation rate is filtered and amplified, and provides a second input to the power amplifier input circuit 21.

As is well known to those skilled in the art, cab signal information is coupled to a track circuit only when the track circuit is occupied. Accordingly, a further output of the code rate selection network 16 is provided as a control input to the cab signal carrier generator 18. In the absence of this control signal, the cab signal carrier generator 18 does not produce the cab signal carrier frequency.

Accordingly, when the track circuit is unoccupied, power amplifier 22 is subjected to an input at the track frequency, modulated at the fixed rate of the code rate generator 11. In some prior art track circuit transmitters, the cab signal carrier generator 18 is never disabled, but when the track circuit is unoccupied, the second input is at a frequency different from the cab signal (or train information) carrier.

The power amplifier input circuit 21 and the power amplifier 22 are arranged to be linear over their operating ranges such that the output to the bond 23 is a linear combination of the input signals, if there are indeed two input signals present.

The bond 23 is well known to those skilled in the art, and is used to couple the output of the track circuit transmitter power amplifier 22 to the track rails themselves. The bond 23 may be tuned for the specific frequencies employed, such that it presents an effective short circuit for other frequencies, for reasons well known to those skilled in the art.

Figure 2:
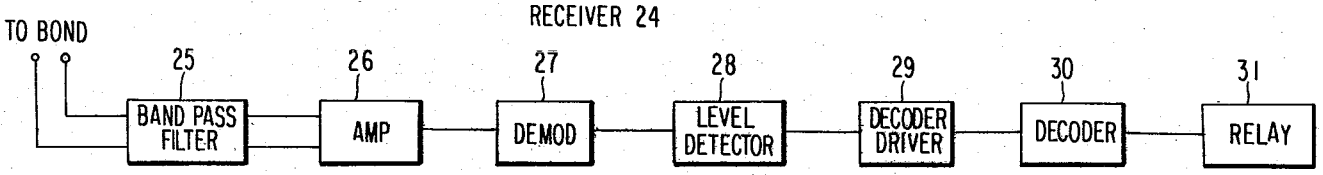
FIG. 2 is a block diagram of a track circuit receiver 24 in accordance with the present invention.

FIG. 2 is a block diagram of a track circuit receiver 24 in accordance with the present invention.

As shown, the receiver 24 is coupled to the bond 23 and includes a bandpass filter 25, tuned at the track frequency. The output of the bandpass filter 25 is coupled to an amplifier 26, whose output is coupled to a demodulator 27 arranged to demodulate the track frequency. The output of the demodulator 27 is a reproduction of the output of the code rate generator 11. The level detection circuit 28 checks that the signal level exceeds the signal level threshold and that the rate of the modulation is below some predetermined threshold.

In prior art receivers, the output of the level detector 28 was coupled to the relay 31 and relay driver. The relay driver picked (or energized) the relay 31 if the code rate exceeded the lowest rate in the system and if the code rate was below some higher threshold established in the level detector. Thus, between the level detector 28 and the relay driver, a check was made to ensure that the modulation code rate was somewhere within the range employed in the track circuit transmitter. In contrast, the present invention includes, between the level detector 28 and the relay 31, a decoder driver 29 and a decoder 30. This apparatus is tuned to the rate of the corresponding fixed code rate generator 11. Accordingly, the output of the decoder 30 will only pick the relay if the detected code rate is within some tolerance of the rate generated by the fixed code rate generator 11. This reduced bandpass characteristic provides increased noise immunity, especially useful where chopper control traction equipment is employed. In such equipment, the energization and de-energization of high power carrying solid state switches results in a spectrally rich set of harmonics which can induce corresponding currents in a track receiver requiring effective noise immunity to minimize spurious energization of the track delay.

Figure 3:
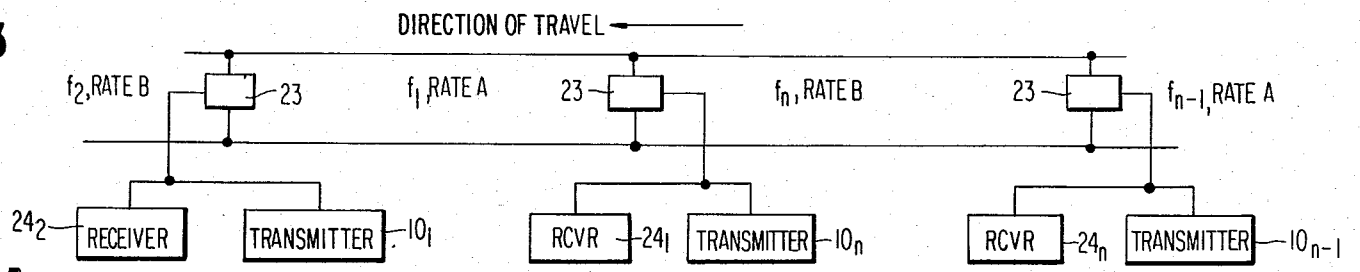
FIG. 3 illustrates how the track circuit of the present invention can be applied in practice.

FIG. 3 illustrates a typical installation in which the normal direction of travel over the rails is shown by the arrow. FIG. 3 illustrates two track sections, the exit end of a third and the entering end of a fourth.

Noted in FIG. 3 is the track frequency for each section; as shown, a sequence of the track frequencies are used in the system, such that, for example, the leftmost portion of the track circuit shown employs a track frequency $f_2$, the first full track section of FIG. 3 employs a track frequency $f_1$, the next track circuit employs a track frequency $f_n$ and finally, the entrance end of the last track circuit shown employs a track frequency $f_{n-1}$. In addition to this change of track frequency, adjacent track circuits also employ different code rates such as the rates A and B.

The need for changing track frequencies from one track circuit to the next is immediately apparent from the connection between the receivers and transmitters. Thus, for example, transmitter $10_1$ is connected to a bond 23 to which is also connected a receiver $24_2$. Were these two adjacent track sections served by the same track frequency, obviously the output of the transmitter $10_1$ would pick the relay in the receiver $24_2$ even if a train was present. By using a sequence of track frequencies, the tendency of train detection currents to falsely energize track relays is reduced.

Figure 4A:
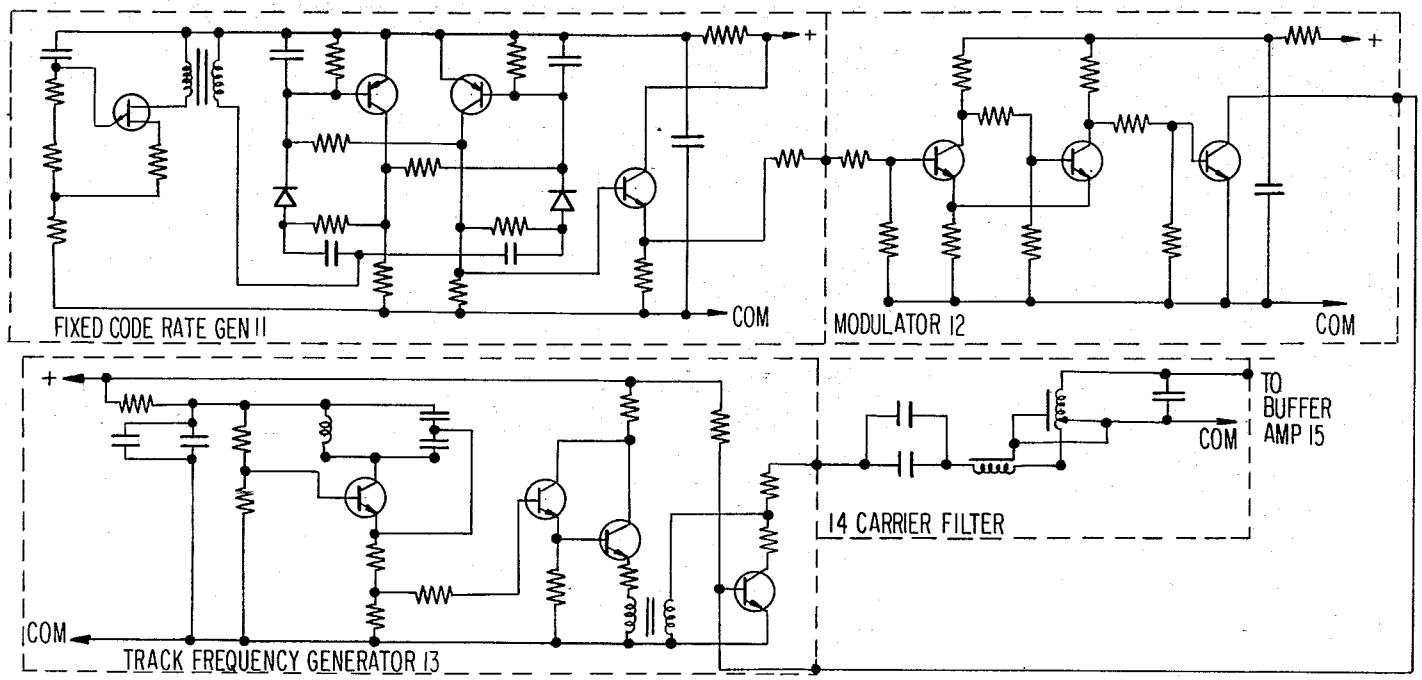
FIGS. 4A and 4B are a detailed block diagram of several components of the transmitter 10 in accordance with the present invention.
Figure 4B:
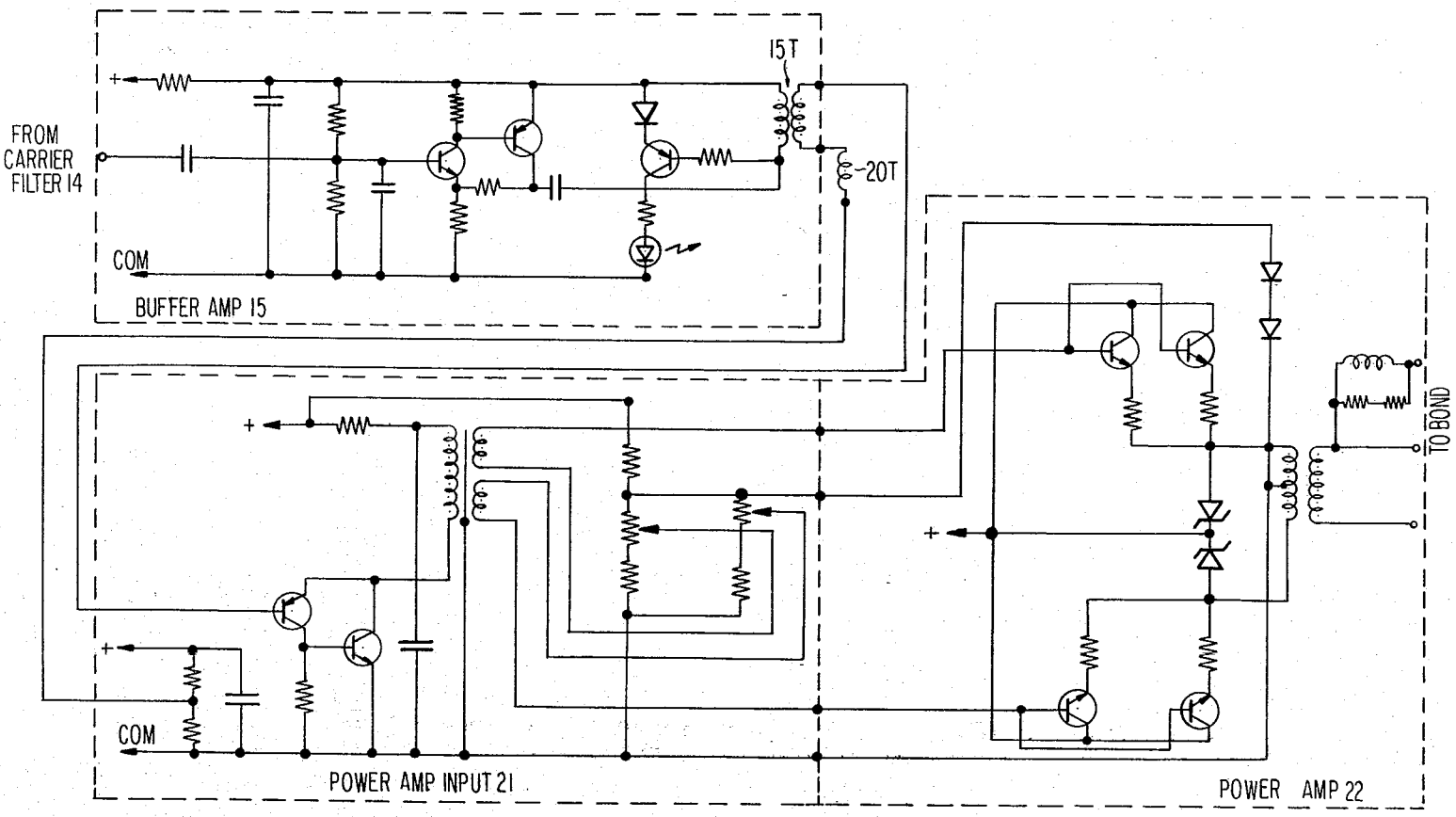

FIGS. 4A and 4B illustrate a schematic diagram of portions of a preferred embodiment of the inventive transmitter 10. The various elements of FIG. 1 are related to the circuits of FIGS. 4A and 4B through the use of identical reference characters. The output of buffer amplifier 15 (at transformer 15-T) is summed with the output of buffer amp 20 and coupled to the input circuit 21. Buffer amplifier 20 is not illustrated although the output transformer 20-T, is shown.

Figure 5:
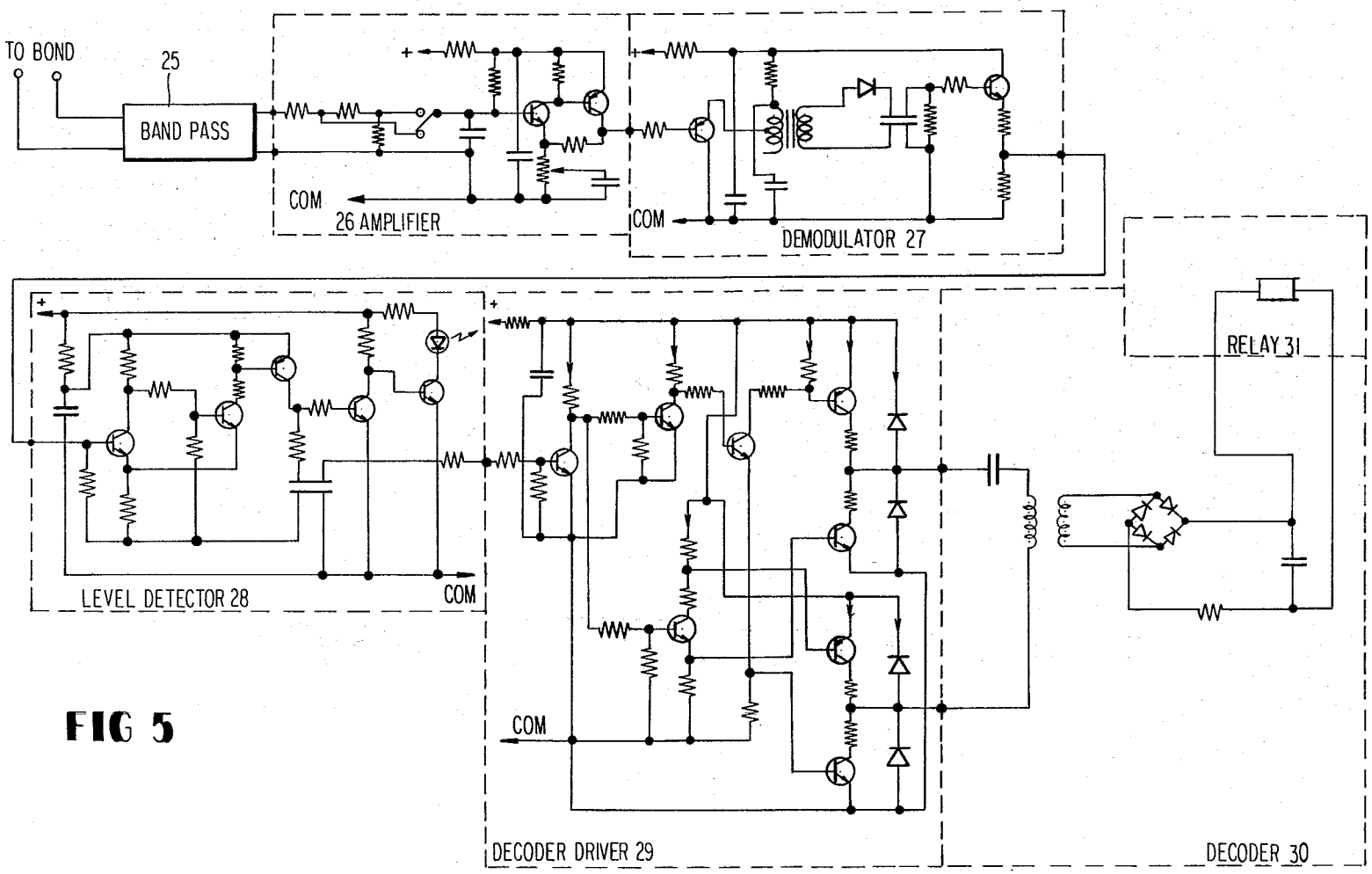
FIG. 5 is a detailed block diagram of a receiver 24 in accordance with the present invention.

FIG. 5 is a similar illustration of a typical track frequency receiver. The reference characters in FIG. 5 are keyed to those used in FIG. 2. In operation, the demodulator 27 passes a usable signal only in response to receipt of track frequency current for which the bandpass filter is tuned. The level detector 28 passes on a detectable signal in the event that the output of demodulator 27 is above some threshold set by the detector 28. The decoder 30, tuned to a specific code rate, acts to pick the relay when energy of the proper modulation is detected.

Figure 6A:
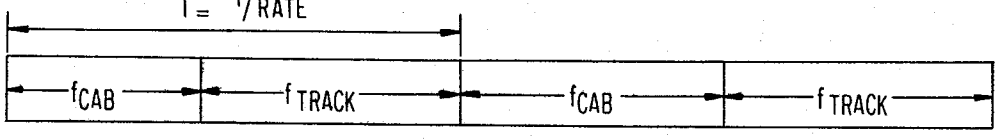
FIG 6A PRIOR ART
FIGS. 6A and 6B illustrate, respectively, a signal sequence of track circuit current in accordance with the prior art, and in accordance with the present invention.

FIG. 6A illustrates the output of a prior art track circuit transmitter, when the associated track circuit is occupied. As is shown in FIG. 6A, the output frequency varies at the modulation rate from cab signal carrier frequency ($f_{cab}$) to track frequency carrier ($f_{track}$). In other words, at the modulation rate, first the cab signal carrier is present, and then the track frequency carrier is present, and the sequence alternates. Because, in the prior art, the modulation rate was variable, in accordance with traffic information, the track circuit receiver was arranged to respond to track frequency carrier, at any modulation rate within the range employed in the train protection system. Of course, the prior art track circuit transmitters, in the absence of an occupied track section, would not carry cab signal carrier frequency at all, and in that case, the track frequency carrier would alternate with periods of no signal, again at a modulation rate within the range employed in the system.

Figure 6B:
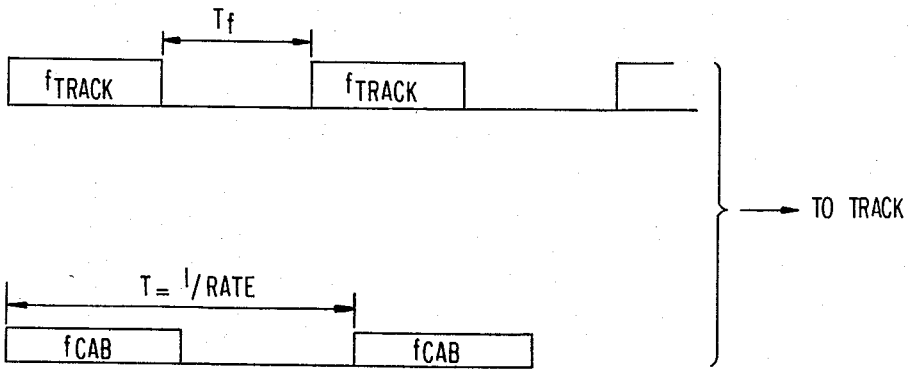

FIG. 6B illustrates two signal sequences, which are actually applied to the track rails when a track section is occupied in accordance with the inventive equipment. One of the signal sequences, shown at the upper portion of FIG. 6B, comprises the track frequency carrier ($f_{track}$) which alternates with no signal, at the rate of the fixed code rate generator 11, i.e., the period $T_f$ is equal to the reciprocal of the rate. For a particular section this rate is fixed, although a system includes at least two different rates. The other signal sequence corresponds to the cab signal carrier frequency ($f_{cab}$) which alternates with no signal, at one of the modulation rates selected by the code rate selection network 16 and established by one of the code rate generators 16-1 through 16-N. Of course, in the event the associated track circuits are unoccupied, then there is no signal at the cab signal carrier frequency, although the signal at the track frequency is, of course, present. Significantly, the modulation rate of the track frequency carrier remains unchanged, regardless of traffic conditions. As a result, the receiver can be sharply tuned to detect the track frequency carrier at the fixed code rate fixed by the code rate generator 11.

From the foregoing it should be apparent that the inventive track circuit provides for a fixed modulation rate track frequency signal. Accordingly, the receiver can use a sharply tuned decoder thus significantly increasing the noise immunity of the train detection equipment. The circuits illustrated herein are exemplary and thus should not be construed as limiting. The scope of the invention is set out in the following claims.

What is claimed is:

1. An automatic protection system for trains traversing a plurality of uninsulated track sections along track rails comprising:

transmitting and receiving equipment spaced along said track rails, said transmitting equipment including;

a track frequency oscillator;

modulation means for modulating a signal produced by said track frequency oscillator only at a fixed code rate and producing a modulated track frequency signal;

cab signaling means producing selectively modulated cab signaling energy;

amplifying means for amplifying said modulated track frequency signal and said cab signaling energy;

bond means for applying said amplified modulated track frequency signal to said track rails, said receiving equipment including:

decoder means responsive to signals derived from said track rails and tuned only to said fixed code rate, for producing a detectable output in response to detection of a signal at said fixed code rate, and output means operated to a distinctive condition only in response to said detectable output from said decoder means.

2. The apparatus of claim 1 wherein said receiving equipment includes:

a track bond coupled to said track rails, a bandpass filter coupled to said track bond, demodulator means responsive to an output signal from said bandpass filter for producing a demodulator output in response to a demodulator input in the vicinity of a frequency determined by said track frequency oscillator, level detector means coupled between said demodulator means and said decoder means for driving said decoder means if said demodulator means produces a demodulator output above a predetermined threshold.

3. The apparatus of claim 1 wherein said cab signaling means includes:

cab signal carrier generating means for generating at least one carrier frequency detectable by train carried equipment, a plurality of code rate generators each generating a different code rate, selection means for selectively coupling a selected code rate generator to a modulator means, modulator means coupled to said selection means and to said cab signal carrier generating means for modulating said at least one carrier frequency with said selected code rate, and means coupling said modulated cab signal carrier frequency to said amplifying means.

4. The apparatus of claim 3 in which said amplifying means comprises an input amplifier means with at least two inputs for linearly combining signals presented at said inputs, one said input coupled to said modulated track frequency signal.

5. The apparatus of claim 4 in which said transmitter includes a filter and amplifier serially coupling said modulated cab signal carrier frequency to said amplifying means.

6. The apparatus of claim 1 which includes second transmitting and receiving equipment spaced along said track rails in the same direction as the spacing of said transmitting and receiving equipment, said second transmitting equipment coupled to said track rails through a second bond means, said second transmitting equipment including a second track frequency oscillator of second track frequency different from said track frequency and a second modulation means for modulating said second track frequency with a second fixed code rate different from said fixed code rate.

7. The apparatus of claim 6 in which said receiving equipment is coupled to said second bond means and said second receiving equipment is coupled to a third bond means.

* * * * *